US007223107B2

(12) United States Patent
Mao

(10) Patent No.: US 7,223,107 B2
(45) Date of Patent: May 29, 2007

(54) BOARD-MOUNTED ELECTRICAL CONNECTOR WITH BALANCED SOLDER ATTACHMENT TO A CIRCUIT BOARD

(75) Inventor: Yu Hua Mao, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/940,302

(22) Filed: Sep. 13, 2004

(65) Prior Publication Data

US 2005/0059277 A1 Mar. 17, 2005

(30) Foreign Application Priority Data

Sep. 12, 2003 (CN) ..... 2003 2 78582

(51) Int. Cl.
*H01R 12/00* (2006.01)

(52) U.S. Cl. ..... 439/83

(58) Field of Classification Search ..... 439/83, 439/74, 101, 108

See application file for complete search history.

(56) References Cited

U.S. PATENT DOCUMENTS 4,349,237 A * 9/1982 Cobaugh et al. ..... 439/377
4,582,386 A * 4/1986 Martens ..... 439/631
5,192,232 A * 3/1993 Lenz et al. ..... 439/660
5,310,357 A * 5/1994 Olson ..... 439/346
5,466,171 A * 11/1995 Bixler et al. ..... 439/378
5,667,388 A * 9/1997 Cottrell ..... 439/74
5,697,799 A * 12/1997 Consoli et al. ..... 439/181
5,860,814 A * 1/1999 Akama et al. ..... 439/74
6,007,352 A * 12/1999 Azuma et al. ..... 439/108
6,093,046 A * 7/2000 Chiou et al. ..... 439/378
6,210,225 B1 * 4/2001 Cai et al. ..... 439/607
6,524,114 B2 * 2/2003 Watanabe et al. ..... 439/65
6,805,586 B2 * 10/2004 Akama et al. ..... 439/608
6,848,950 B2 * 2/2005 Allison et al. ..... 439/682

* cited by examiner

*Primary Examiner*—Neil Abrams
(74) *Attorney, Agent, or Firm*—Wei Te Chung

(57) ABSTRACT

An electrical connector (1) includes a dielectric housing (2), a number of power terminals (4) at one end of the housing, signal terminals (5) and solder pad contacts (6) disposed at the other end of the housing opposite to the power terminals. The housing includes a base portion (20) and a bottom portion (21) and defines a number of passageways (212, 213, 215) extending through the bottom portion. The terminals (4, 5) received in the passageways (212, 213) each have a contact portion (40, 50) and a solder foot (41, 51). The solder pad contacts and the power terminals have a width greater than the signal terminals. The solder pad contacts are upwardly inserted into the passageways (215) of the base portion from the bottom portion and each includes a retention portion (60) for interfering with the base portion and a solder foot (61) extending beyond the bottom portion. Use of wide power terminals and wide solder pad contacts at the other end of the housing provides balanced solder attachment to a pcb. The solder pad contacts are used solely for securement to the pcb.

12 Claims, 7 Drawing Sheets

BOARD-MOUNTED ELECTRICAL CONNECTOR WITH BALANCED SOLDER ATTACHMENT TO A CIRCUIT BOARD

BACKGROUND OF THE INVENTION

1. Field of the Invention

The present invention is related to an electrical connector, and more particularly to a board-mounted electrical connector for use in a notebook computer.

2. Description of Related Art

An electrical connector mostly comprises a dielectric housing and a plurality of conductive terminals received in the dielectric housing. The plurality of conductive terminals generally include power terminals, signal terminals and grounding terminals. Generally, the power terminal has a width greater than the signal terminal and the grounding terminal for the electrical current that the power terminals conduct is larger than that of the signal terminals. However, because the width of the power terminal is added, the soldering portion of the power terminal has higher soldering intensity than the signal terminal. When the power and signal terminals are distributed asymmetrically in the electrical connector and the electrical connector is mounted onto a printed circuit board, the electrical connector will have unbalanced soldering intensity. Consequently, the soldering area between the signal terminal and the printed circuit board is easily broken off when the electrical connector repeatedly connects with/detaches from a complementary connector or due to an accidental external force, thereby resulting in deformation of the electrical connector and even leading to break the electrical interconnection between the electrical connector and the printed circuit board and thus affect normal signal transmission.

Hence, it is requisite to provide an electrical connector having balanced soldering intensity and improved connector reliability to overcome the above-mentioned disadvantages of the related art.

SUMMARY OF THE INVENTION

Accordingly, an object of the present invention is to provide an electrical connector having balanced soldering intensity so as to be securely assembled onto a printed circuit board and ensure a reliable signal transmission of the whole electrical connector.

In order to achieve the object set forth, an electrical connector in accordance with the present invention comprises a dielectric housing, a plurality of power terminals at one end of the dielectric housing, signal terminals, and solder pad contacts disposed at the other end of the dielectric housing opposite to the power terminals. The dielectric housing includes a base portion and a bottom portion integrally connecting with the base portion and defines a plurality of passageways extending through the bottom portion. The terminals received in the passageways each have a contact portion for mating with a complementary connector and a solder foot extending beyond the bottom portion for electrically engaging with a printed circuit board. The solder pad contacts have a width greater than the signal terminals. The solder pad contacts are upwardly inserted into the base portion from the bottom portion of the dielectric housing and each comprise a retention portion for interferentially mating with the base portion and a solder foot extending beyond the bottom portion for mechanically connecting with the printed circuit board.

Other objects, advantages and novel features of the invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
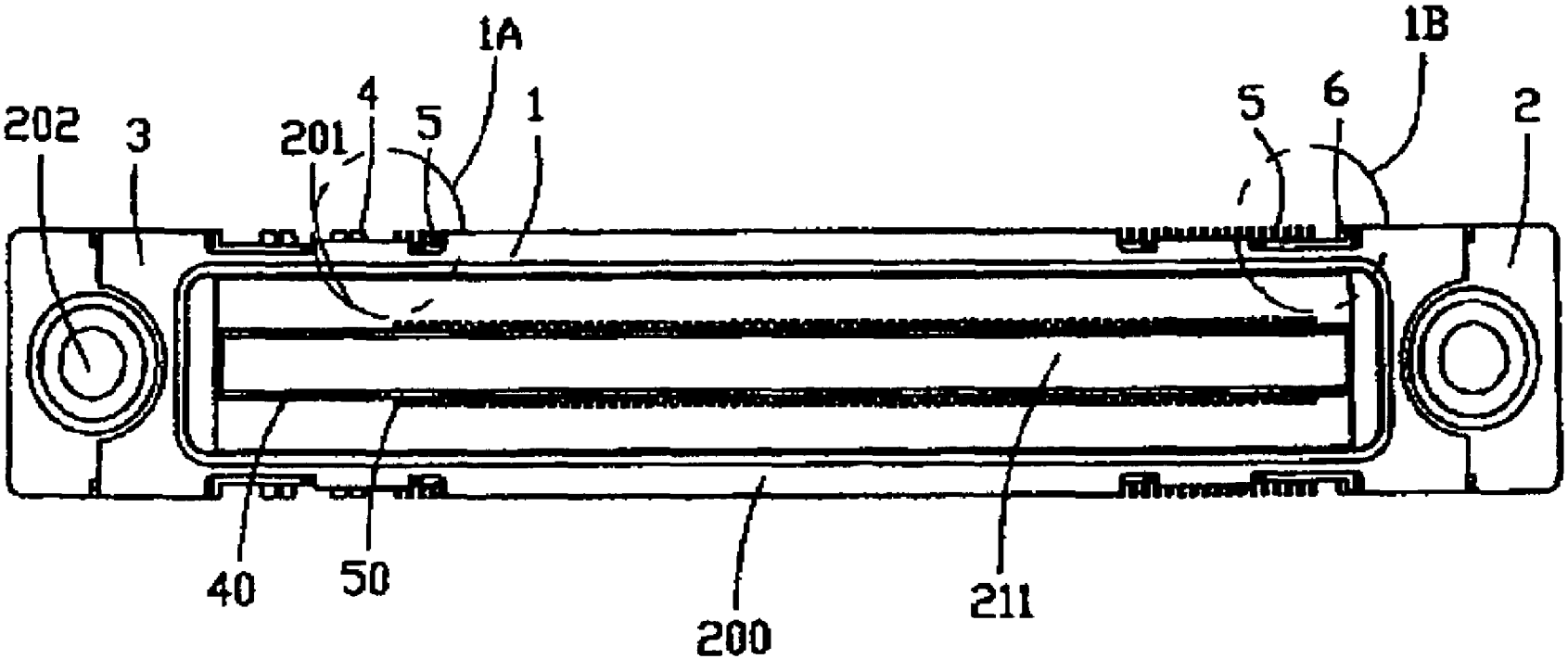
FIG. 1 is a top plan view of an electrical connector in accordance with the present invention.

Referring to FIG 1, an electrical connector 1 in accordance with the present invention comprises a dielectric housing 2, a shielding shell 3 attached on the dielectric housing 2, a plurality of power terminals 4, signal terminals 5, and solder pad contacts 6 received in the dielectric housing 2.

Figure 2:
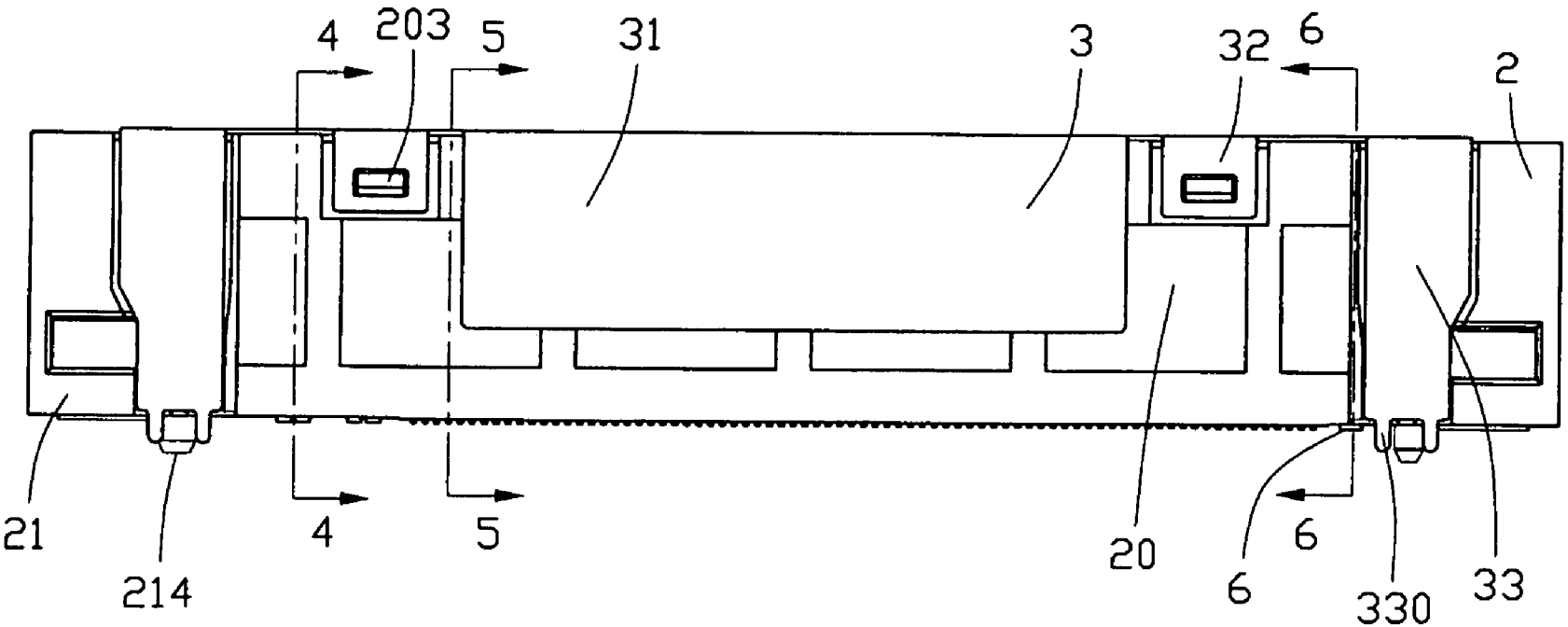
FIG. 2 is a front plan view of the electrical connector.
Figure 3:
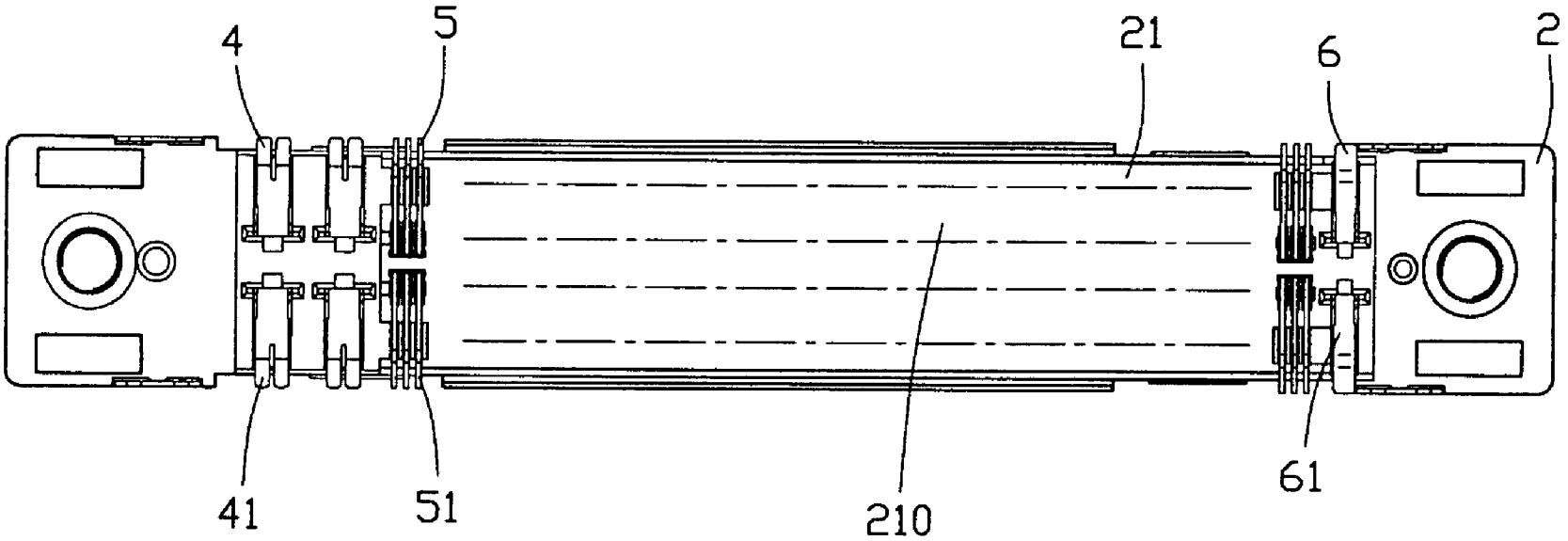
FIG. 3 is a bottom plan view of the electrical connector.
Figure 4:
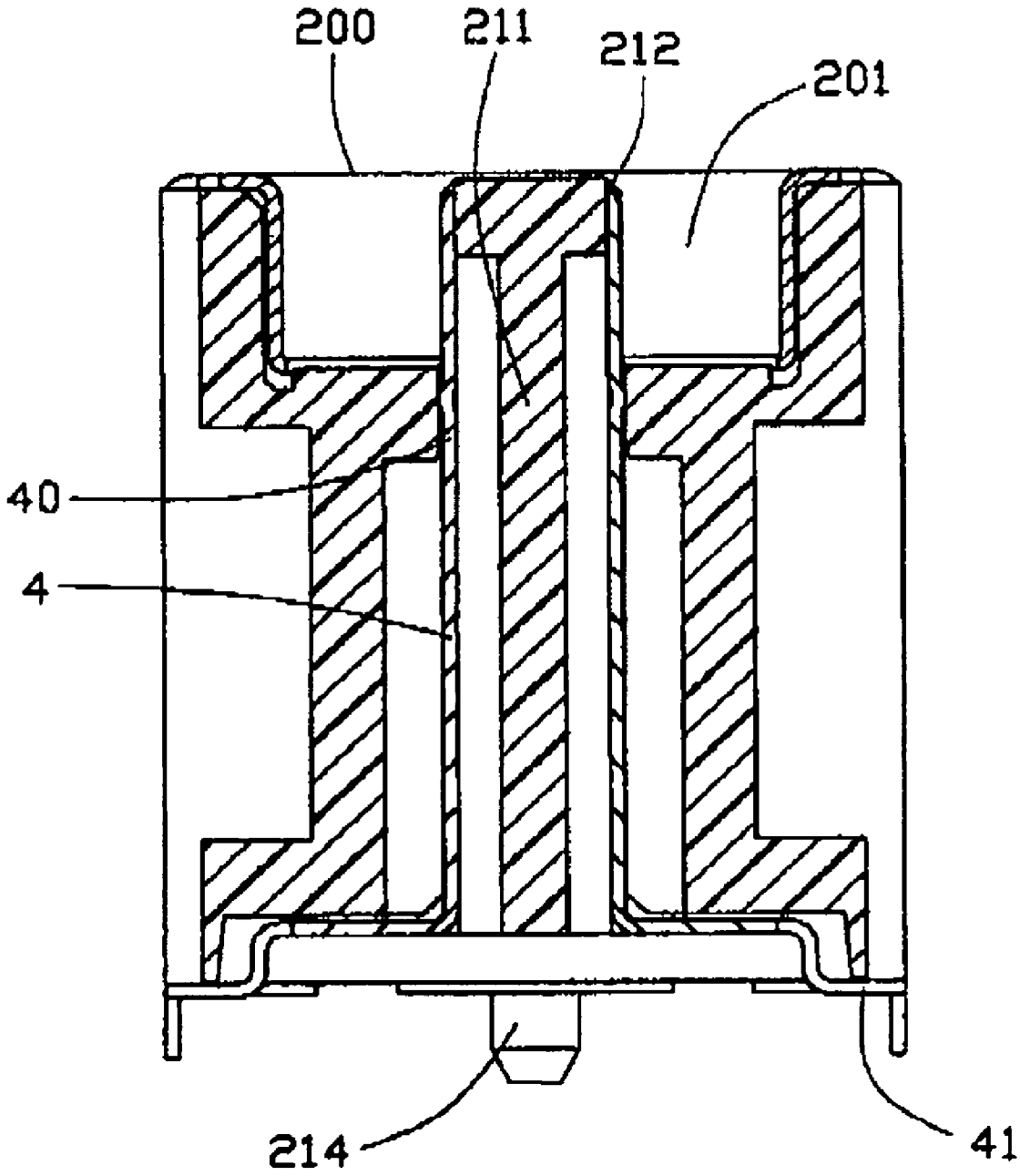
FIG. 4 is a cross-sectional view of the electrical connector taken along line 4—4 of FIG. 2.
Figure 5:
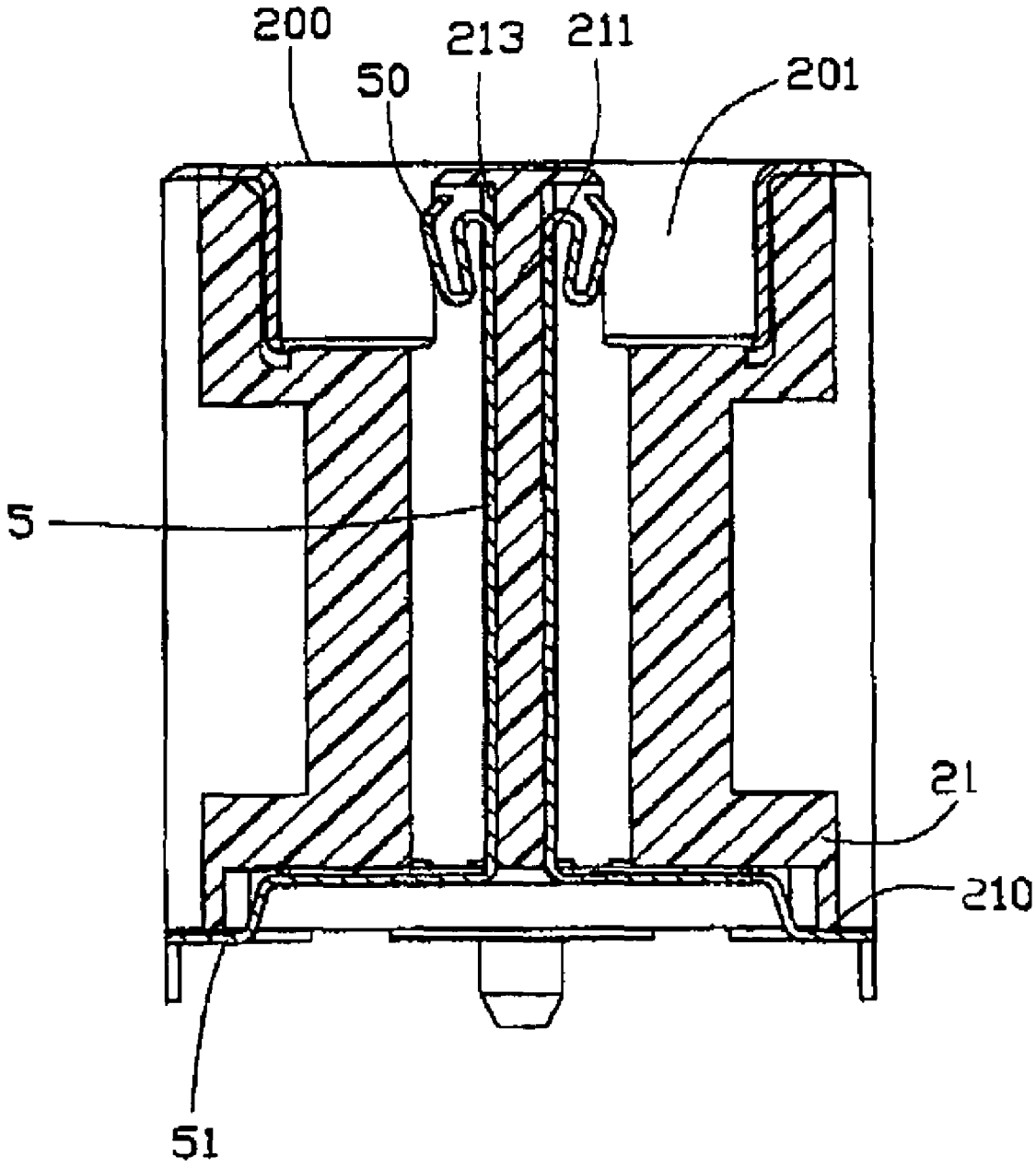
FIG. 5 is a cross-sectional view of the electrical connector taken along line 5—5 of FIG. 2.

Referring to FIGS. 1 to 3 in conjunction with FIGS. 4 and 5, the dielectric housing 2 is rectangular and comprises a base portion 20 and a bottom portion 21 integrally connecting with the base portion 20. The base portion 20 has a mating surface 200 for mating with a complementary connector (not shown) and the bottom portion 21 has an engaging surface 210 parallel to and for mounting to a top surface of a printed circuit board (not shown). The base portion 20 defines an elongated plug-receiving chamber 201 and the chamber 201 is divided longitudinally by a central partition 211 projecting upwardly from the bottom portion 21. A plurality of passageways 212, 213, 215 are defined in two opposite sides of the central partition 211 and downwardly extending through the bottom portion 21 of the dielectric housing 2. The dielectric housing 2 has a pair of circular guiding holes 202 exposed at two opposite ends of the mating surface 200 for providing insertion of guiding pins of the complementary connector, and a pair of locating posts 214 at two opposite ends of the engaging surface 210 for retaining the electrical connector 1 onto the printed circuit board. Additionally, the dielectric housing 2 provides a plurality of latch bosses 203 projecting outwardly from two opposite side surfaces of the base portion 20 thereof.

Figure 1A:
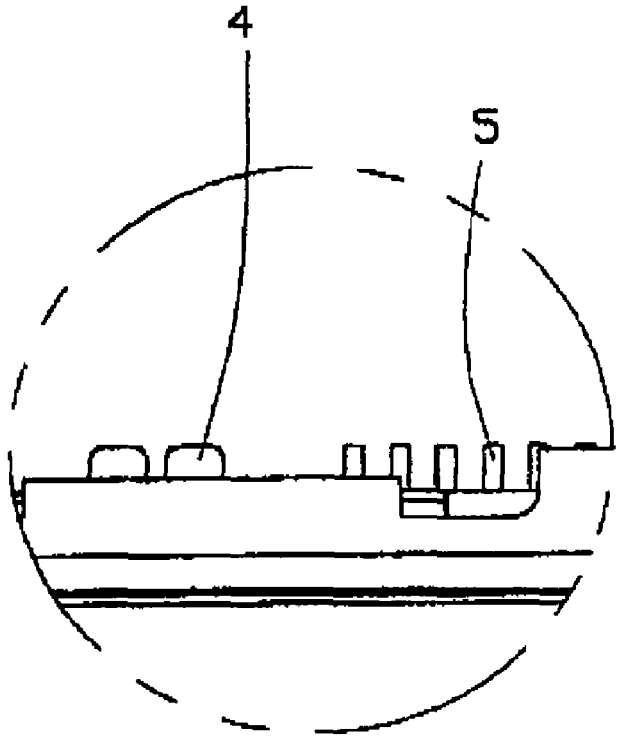
FIGS. 1A and 1B are enlarged views of circle portions of FIG 1.

With reference to FIGS. 3–5, the power terminals 4 and the signal terminals 5 are respectively received in corresponding passageways 212, 213 of the dielectric housing 2. The power terminals 4 are arranged in one end of the dielectric bowing 2 and have a width greater than the signal terminals 5 (as shown in FIG. 1A). Each power terminal 4 includes a contact portion 40 (FIG 4) extending to the mating surface 200 and each signal terminal 5 has resilient contact portions 50 (FIG. 5) which project laterally outwardly into the plug-receiving chamber 201 for mating with corresponding conductive contacts of the complementary connector. Each power/signal terminal 4, 5 comprises a soldering foot 41/51 opposite to the contact portion 40/50 and extending beyond the engaging surface 210 of the dielectric housing 2 for mechanically and electrically connecting with the printed circuit board.

Figure 1B:
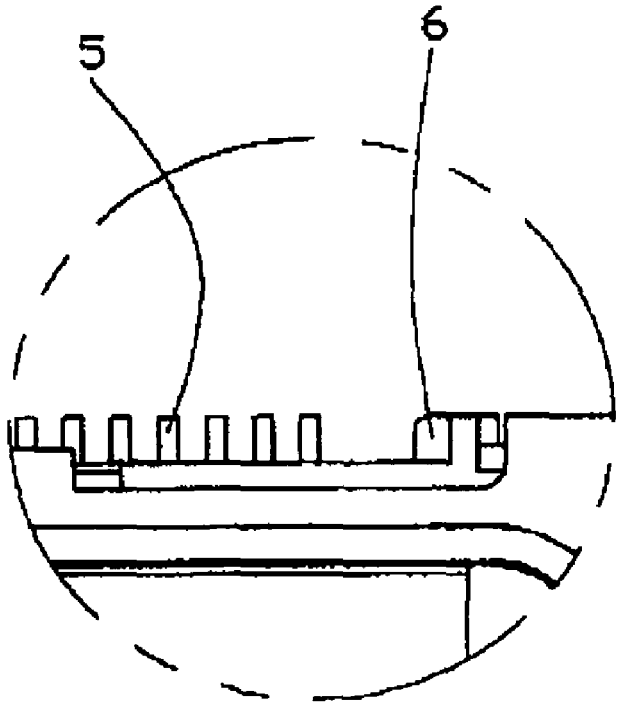
Figure 6:
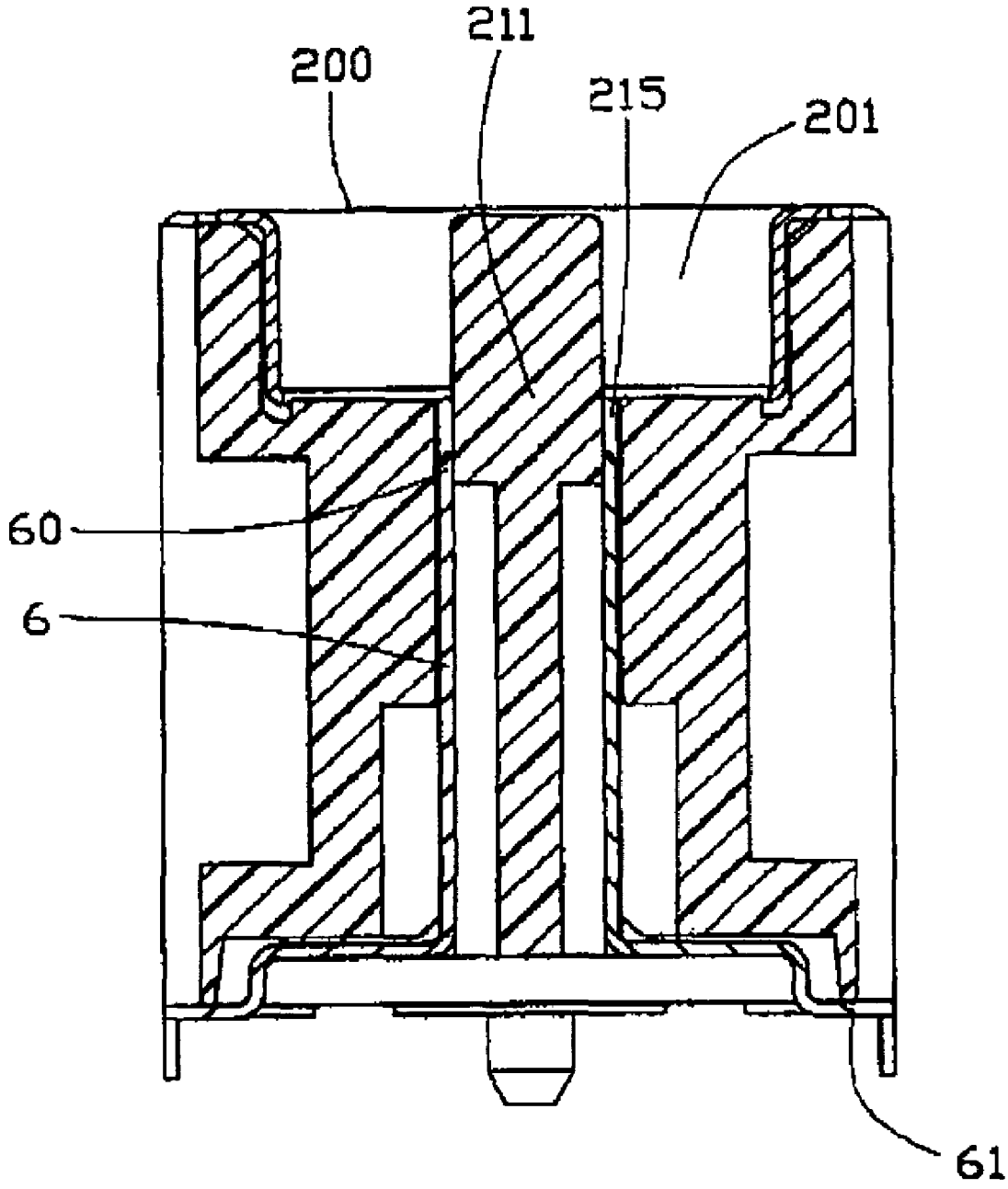
FIG. 6 is a cross-sectional view of the electrical connector taken along line 6—6 of FIG. 2.

With reference to FIGS. 3 and 6, the solder pad contacts 6 are arranged in the other side of the dielectric housing 2 opposite to the power terminals 4 and have a width greater than the signal terminals 5 (as shown in FIG 1B). Each solder pad 6 includes a retention portion 60 received in the passageway 215 for interferentially mating with the base portion 21 and a solder foot 61 extending beyond the engaging surface 210 of the dielectric housing 2 for mechanically engaging with the printed circuit board.

With reference to FIGS. 2 and 3 along with FIGS. 4–6, the shielding shell 3 comprises an inner frame overlaid with inner walls of the received chamber 201 a casing 31 partly enclosing the base portion 20 of the dielectric housing 2, two pairs of locking tabs 32 having rectangular holes (not labeled) for receiving the latch bosses 203, and a pair of wing sections 33 integrally and downwardly extending from two opposite longitudinal sides of the casing 31. Each wing section 33 provides a pair of solder feet 330 in a bottom edge thereof and perpendicular to the engaging surface 210 of the dielectric housing 2.

Referring to FIGS. 1–6, in assembly, both the power terminals 4 and the signal terminals 5 are upwardly inserted therein from the engaging surface 210 of the dielectric housing 2 and respectively received in corresponding passageways 212, 213 with the contact portions 40, 50 thereof extending to the mating surface 200 and the solder feet 41, 51 extending beyond the engaging surface 210. Similarly, the solder pad contacts 6 are upwardly inserted in corresponding passageways 215 of the dielectric housing 2 from the engaging surface 210 with the solder feet 61 protruding beyond the engaging surface 210. The retention portions 60 of the solder pad contacts 6 pass through the bottom portion 21 of the dielectric housing 2 to interfere with the base portion 20 so as to retain the solder pad contacts 6 in the dielectric housing 2. The shielding shell 3 is attached to the dielectric housing 2. The casing 31 of the shielding shell 3 firstly encloses the base portion 20 of the dielectric housing 2 so that the shielding shell 3 is preliminarily positioned on the dielectric housing 2. Then the locking tabs 32 of the shielding shell 3 snappingly engage with corresponding latch bosses 203 of the base portion 20, thus the shielding shell 3 is securely fixed to the dielectric housing 2 with the solder feet 330 extending beyond the engaging surface 210 of the dielectric housing 2.

When the electrical connector 1 is mounted onto the printed circuit board, the solder feet 61 of the solder pad contacts 6 are soldered on the printed circuit board, thereby increasing the soldering intensity between the electrical connector 1 and the printed circuit board. Because the solder pad contacts 6 are disposed in one end of the dielectric housing 2 opposite to the power terminals 4, the electrical connector 1 has balanced soldering intensity to ensure a reliable electrical connection between the signal terminals 5 and the printed circuit board. By increasing the solder pad contacts 6, the electrical connector 1 can be securely retained in the printed circuit board so that the electrical connector 1 has better and reliable signal transmission quality. Furthermore, the solder pad contacts 6 in accordance with the present invention are simple in structure and easily acquired by changing the existing power terminals 4 minorly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing defining a plurality of passageways extending therethrough and a receiving chamber therein;

a shielding shell having an inner frame overlaid with inner walls of said receiving chamber;

a plurality of power and signal terminals received in said passageways and each having a contact portion exposed to the receiving chamber and a solder foot extending beyond said dielectric housing, the solder foot of the power terminals generally having a greater width than that of the signal terminals, the power terminals disposed at one end of the dielectric housing; and at least one solder pad contact disposed in one of said passageways at the other end of the dielectric housing opposite to the power terminals, the solder pad contact having a solder foot extending beyond said dielectric housing and having a greater width than that of the signal terminal, the solder pad contact not exposed to the receiving chamber and used solely for attachment to a printed circuit board so as to cooperate with the power terminals in providing a balanced solder attachment to the printed circuit board.

2. The electrical connector as claimed in claim 1, wherein said dielectric housing comprises a base portion having a mating surface, and a bottom portion integrally connecting with the base portion and having an engaging surface.

3. The electrical connector as claimed in claim 2, wherein said solder pad contacts are upwardly inserted into the base portion from the bottom portion.

4. The electrical connector as claimed in claim 2, wherein the bottom portion forms a central partition projecting upwardly therefrom and wherein said receiving chanter is defined in said base portion and divided longitudinally by the central partition.

5. The electrical connector as claimed in claim 4, wherein said passageways are defined in two opposite sides of said central partition and extend downwardly through said bottom portion.

6. The electrical connector as claimed in claim 5, wherein said dielectric housing has a pair of guiding holes at two opposite ends of the mating surface and a pair of locating posts at two opposite ends of the engaging surface.

7. The electrical connector as claimed in claim 2, wherein said shielding shell further has a casing and a pair of wing sections integrally and downwardly extending from two opposite longitudinal sides of the casing.

8. The electrical connector as claimed in claim 7, wherein said dielectric housing provides a plurality of latch bosses projecting outwardly from two opposite side surfaces of the base portion.

9. The electrical connector as claimed in claim 8, wherein said shielding shell comprises a plurality of locking tabs having holes integrally and downwardly extending from two opposite longitudinal sides of the casing for engaging with said latch bosses.

10. The electrical connector as claimed in claim 9, wherein each wing section provides a pair of solder feet in a bottom edge thereof and perpendicular to the engaging surface of the dielectric housing.

11. An electrical connector comprising:

a dielectric housing defining a receiving space for receipt of a complementary connector and a plurality of juxtaposed passageways arranged along a longitudinal direction of the housing, each of said passageways extending therethrough in a vertical direction perpendicular to said longitudinal direction;

a plurality of power and signal terminals respectively received in most of said passageways and each of said power and signal terminals having a contact portion exposed to said receiving space in a lateral direction perpendicular to both said longitudinal and vertical directions and a solder foot extending beyond said dielectric housing; and a plurality of L-shaped solder pads contacts disposed in at least some of the remainder of the passageways, each of said solder pads contacts having a width greater than said signal terminal and comprising a retention portion extending in said vertical direction and received in the corresponding passageway and a solder foot extending beyond said dielectric housing; wherein said solder pad contact is not exposed to said receiving space in said direction and used solely for attachment to a printed circuit board.

12. The electrical connector as claimed in claim 11, wherein all the passageways communicates with the receiving space.

* * * * *